US007414586B2

(12) United States Patent
Yu

(10) Patent No.: US 7,414,586 B2
(45) Date of Patent: Aug. 19, 2008

(54) PORTABLE COMMUNICATION DEVICES

(75) Inventor: Kai-Cheng Yu, Taipei County (TW)

(73) Assignee: Qisda Corporation, Taoyuan County (TW)

( * ) Notice: Subject to any disclaimer, the term of this patent is extended or adjusted under 35 U.S.C. 154(b) by 246 days.

(21) Appl. No.: 11/449,938

(22) Filed: Jun. 9, 2006

(65) Prior Publication Data

US 2006/0279473 A1 Dec. 14, 2006

(30) Foreign Application Priority Data

Jun. 10, 2005 (TW) ..... 94119255 A

(51) Int. Cl.
*H01Q 1/24* (2006.01)

(52) U.S. Cl. ..... 343/702; 343/906

(58) Field of Classification Search ..... 343/702, 343/906

See application file for complete search history.

(56) References Cited

U.S. PATENT DOCUMENTS

| | | | | |
|---|---|---|---|---|
| 2,735,932 | A * | 2/1956 | Textrom et al. | 343/702 |
| 5,335,367 | A * | 8/1994 | Adachi et al. | 455/575.7 |
| 5,859,622 | A * | 1/1999 | Phillips | 343/903 |
| 6,266,020 | B1 * | 7/2001 | Chang | 343/702 |
| 7,034,755 | B2 * | 4/2006 | Takagi | 343/702 |

* cited by examiner

*Primary Examiner*—HoangAnh T Le

(57) ABSTRACT

Portable communication devices are provided. A portable communication device includes a housing, an antenna, and a push button. The housing includes a first receiving portion and a second receiving portion. The antenna is detachably disposed in the first receiving portion. The antenna includes a first engaging portion. The battery is detachably disposed in the second receiving portion. The battery includes a second engaging portion. The push button is disposed in the housing and includes a third engaging portion and a fourth engaging portion. The third engaging portion movably engages with the first engaging portion to fix the antenna to the housing. The fourth engaging portion movably engages with the second engaging portion to fix the battery to the housing.

18 Claims, 13 Drawing Sheets

PORTABLE COMMUNICATION DEVICES

BACKGROUND

The invention relates to portable communication devices.

FIG. 1*a* is a rear view of a conventional portable communication device 100. The portable communication device 100 comprises a housing 101, an antenna 102, a battery 103, and a push button 104.

FIG. 1*b* is a diagram of an antenna 102 of the conventional portable communication device 100. The antenna 102 may have a decorative pattern 105 thereon. The antenna 102 comprises a connection portion 106. The antenna 102 is fixed to the housing 101 by engaging the connection portion 106 with a corresponding recess (not shown) of the housing 101, allowing easy replacement of the antenna 102.

Because the connection portion 106 may rotate in the recess occasionally, it is difficult to keep the decorative pattern 105 on the antenna 102 facing the front.

FIG. 1*c* is a schematic diagram of the battery 103 engaged with the push button 104 in the conventional portable communication device 100. FIG. 1*d* is a schematic diagram of the battery 103 detached from the housing 101 of the conventional portable communication device 100. The battery 103 comprises a recess 107, and the push button 104 comprises a hook 108. When the recess 107 engages with the hook 108, the battery 103 is fixed to the housing 101. When the user applies an external force 109 on the push button 104, the recess 107 is separated from the hook 108, allowing detachment of the battery 103 from the housing 101.

To replace the antenna 102 and the battery 103, the antenna 102 and the battery 103 must be detached from the housing 101 one by one, an inconvenient and time-consuming process.

SUMMARY

Portable communication devices are provided. An embodiment of a portable communication device comprises a housing, an antenna, and a push button. The housing comprises a first receiving portion and a second receiving portion. The antenna is detachably disposed in the first receiving portion. The antenna comprises a first engaging portion. The battery is detachably disposed in the second receiving portion. The battery comprises a second engaging portion. The push button is disposed in the housing. The push button comprises a third engaging portion and a fourth engaging portion. The third engaging portion movably engages with the first engaging portion to fix the antenna to the housing. The fourth engaging portion movably engages with the second engaging portion to fix the battery to the housing.

Some embodiments of a portable communication device comprise a housing, an antenna, a battery, and a push button. The antenna is detachably disposed in the housing. The battery is detachably disposed in the housing. The push button is disposed in the housing. The antenna and the battery are connected to the housing by the push button. The push button moves along a Z axis or on a XY plane to selectively separate the antenna or the battery from the housing. The XY plane is perpendicular to the Z axis.

DESCRIPTION OF THE DRAWINGS

The invention can be more fully understood by reading the subsequent detailed description and examples with references made to the accompanying drawings, wherein.

DETAILED DESCRIPTION

A principle aim of the invention is to use a push button to precisely position an antenna of a portable communication device. Moreover, the antenna and a battery can be detached from a housing simultaneously using the push button.

More specifically, the antenna is detached from the housing by pressing the push button in one direction, and the battery is detached from the housing by pushing the push button in another direction. Additionally, both the antenna and the battery can be simultaneously detached from the housing by pressing and pushing the push button.

Figure 1A:
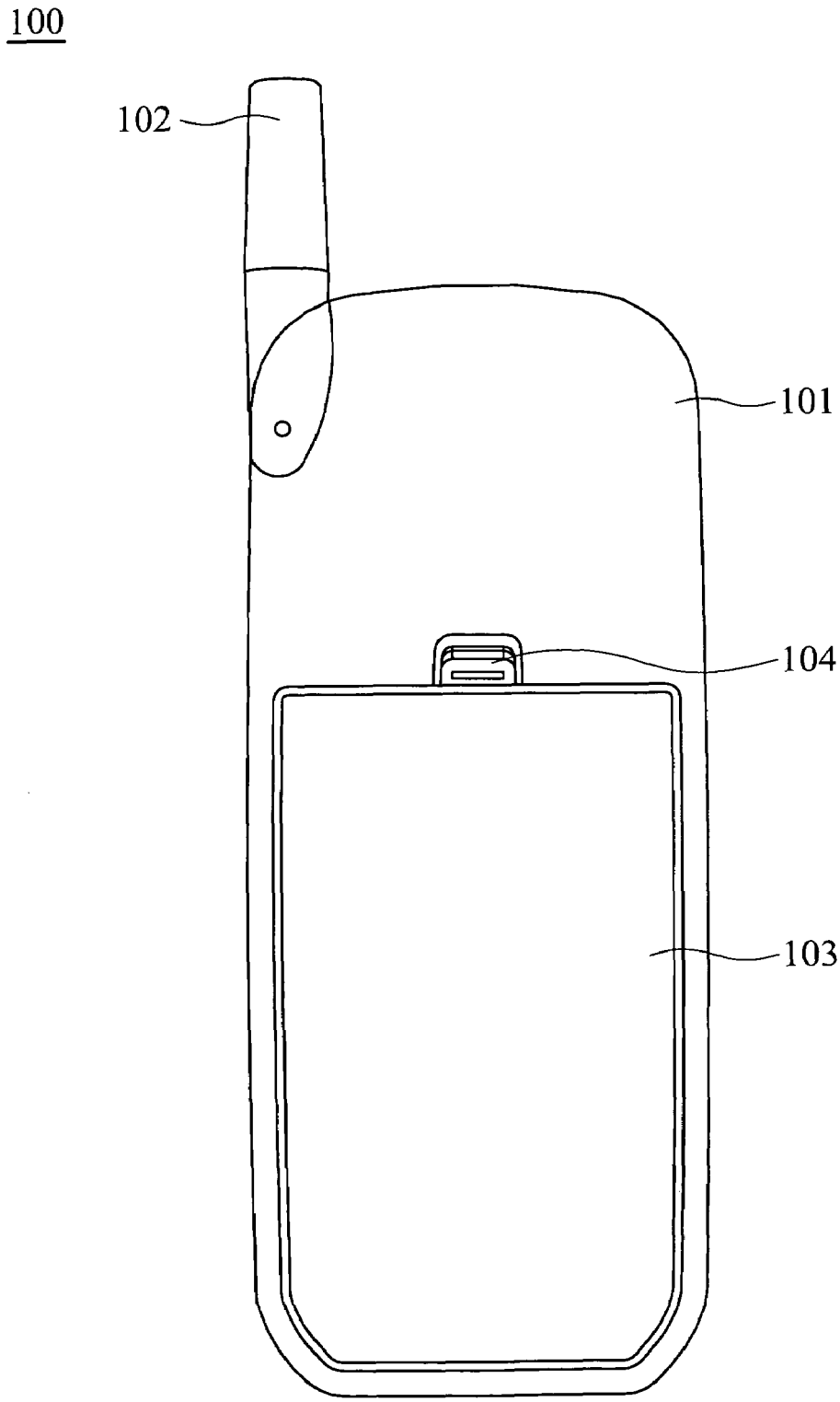
FIG. 1*a* is a rear view of a conventional portable communication device.
Figure 1B:
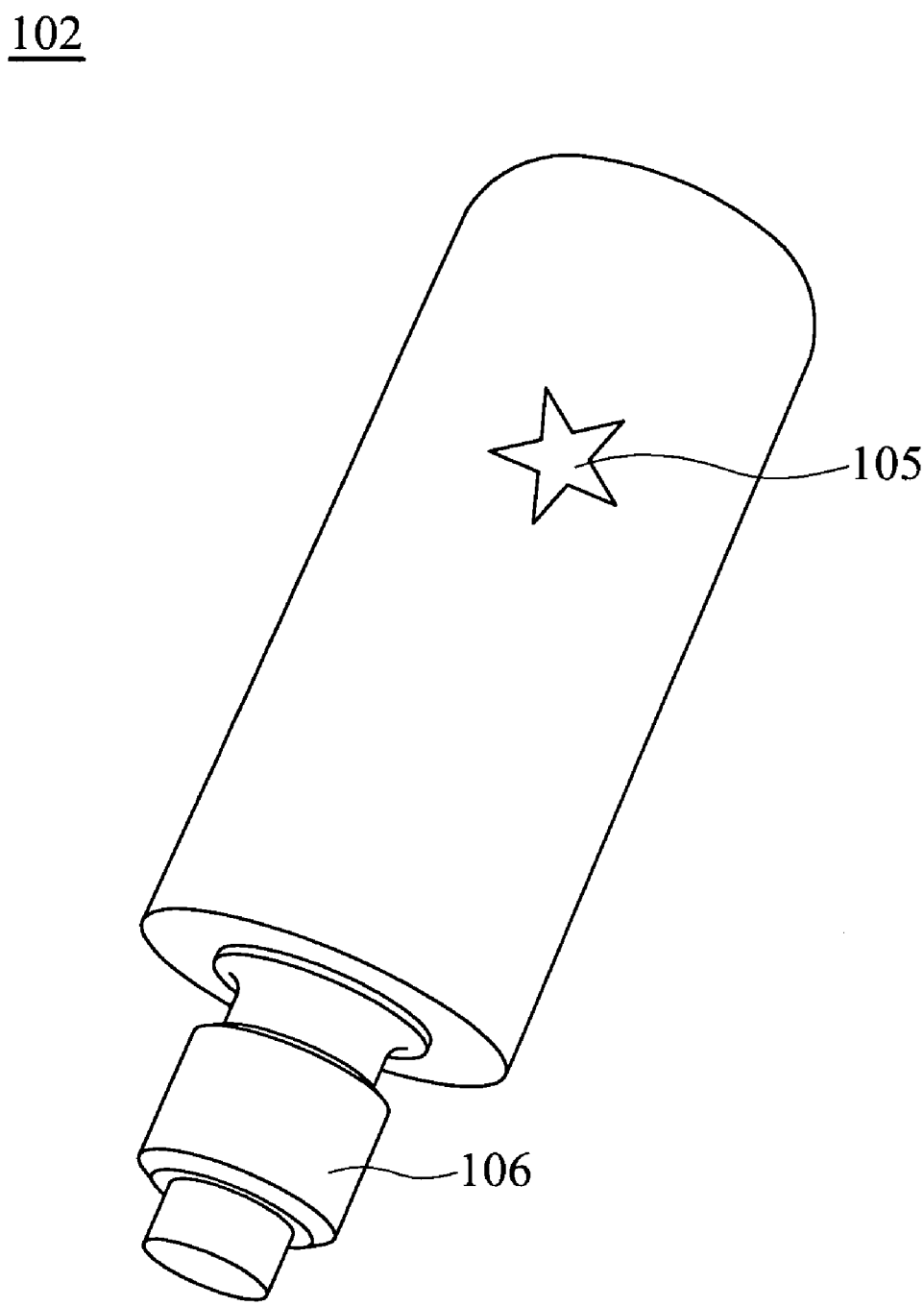
FIG. 1*b* is a diagram of an antenna of a conventional portable communication device.
Figure 1C:
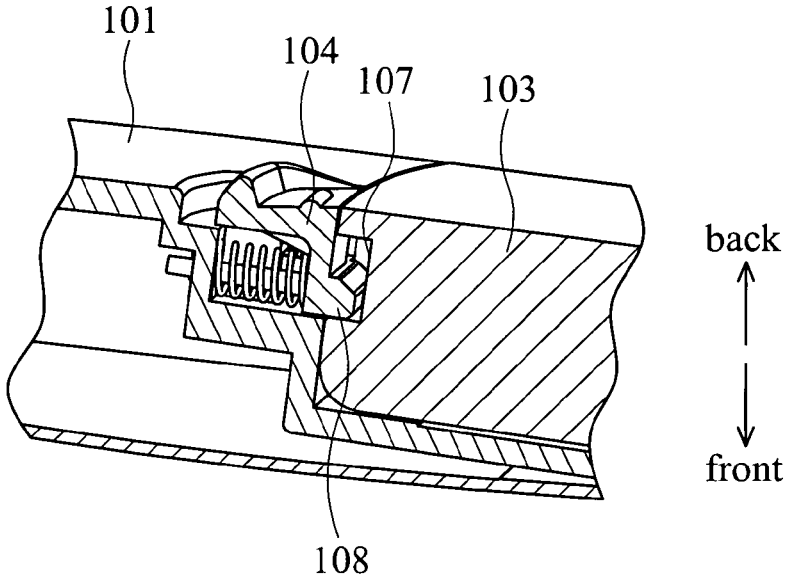
FIG. 1*c* is a schematic diagram of a battery engaged with a push button in a conventional portable communication device.
Figure 1D:
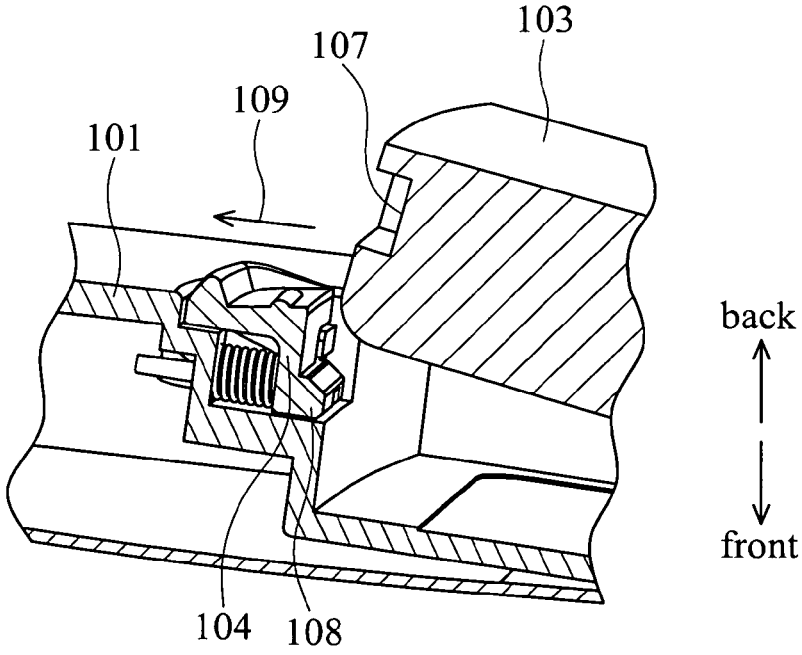
FIG. 1*d* is a schematic diagram of a battery detached from a housing of a conventional portable communication device.
Figure 2:
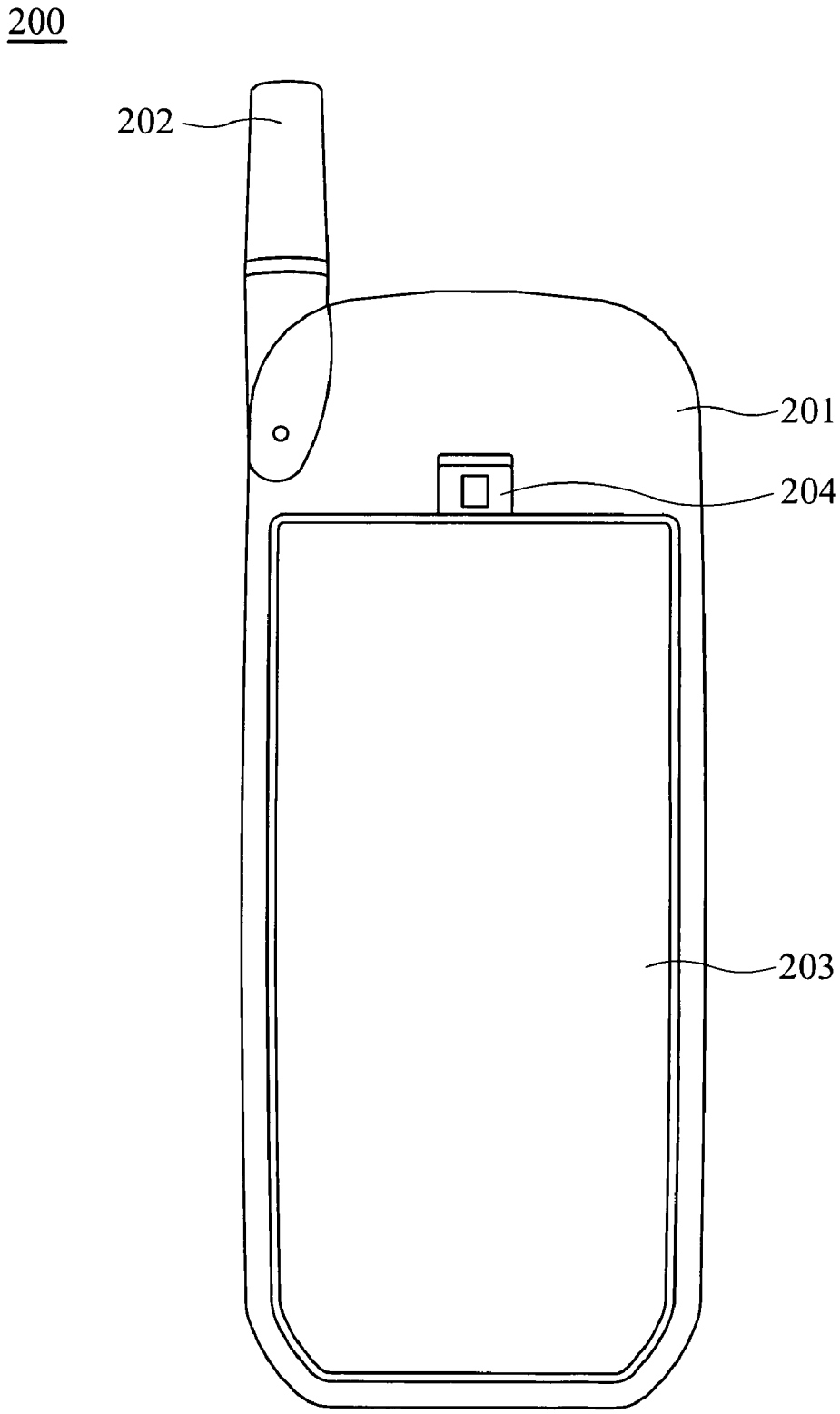
FIG. 2 is a rear view of an embodiment of a portable communication device.

FIG. 2 is a rear view of an embodiment of a portable communication device 200. The portable communication device 200 comprises a housing 201, an antenna 202, a battery 203, and a push button 204. The antenna 202 has a decorative pattern 205 thereon.

First, the method to detach the antenna 202 from the housing 201 by the push button 204 will be described in greater detail in the following.

Figure 3A:
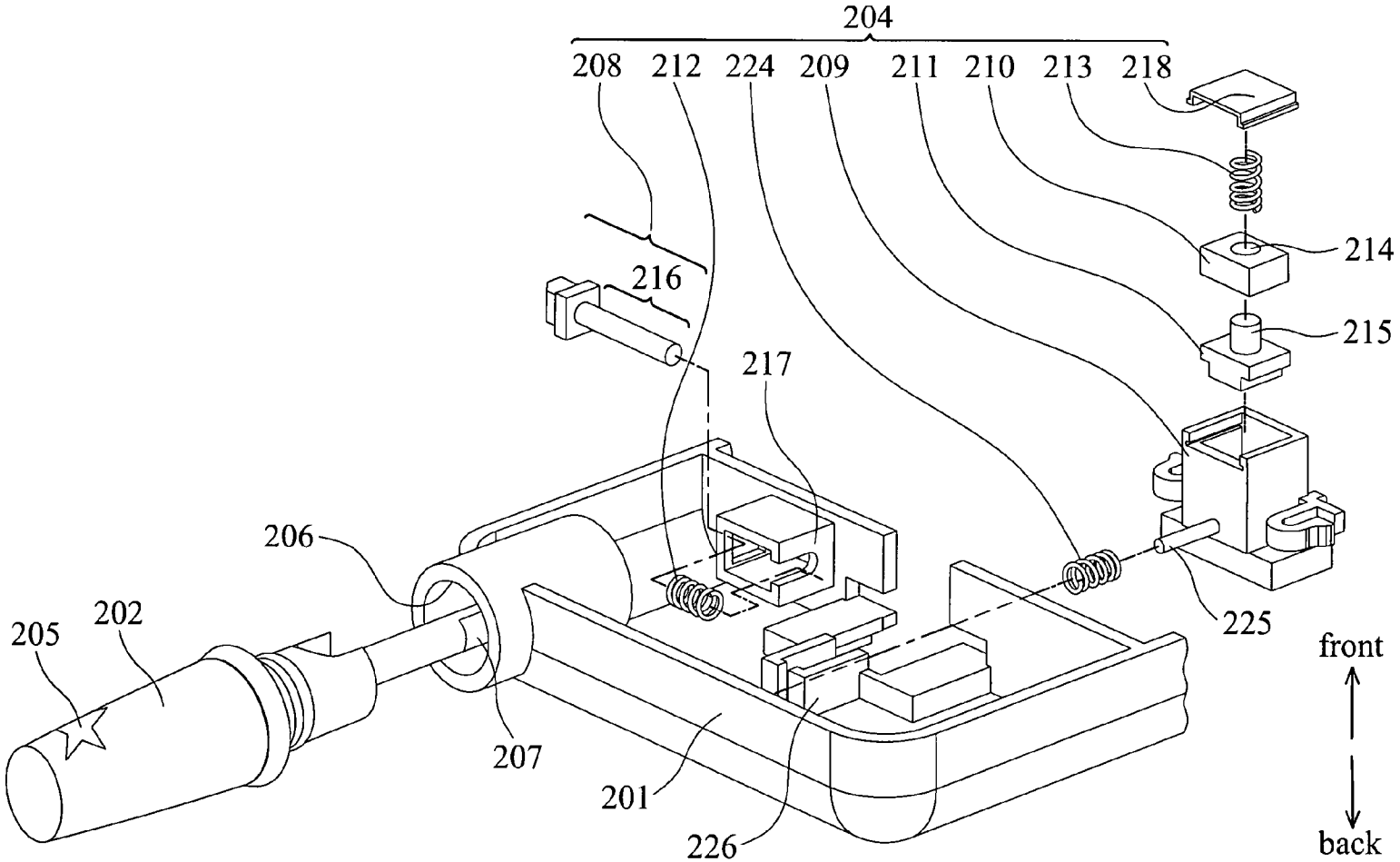
FIG. 3*a* is a partial exploded view of an embodiment of a portable communication device.
Figure 3B:
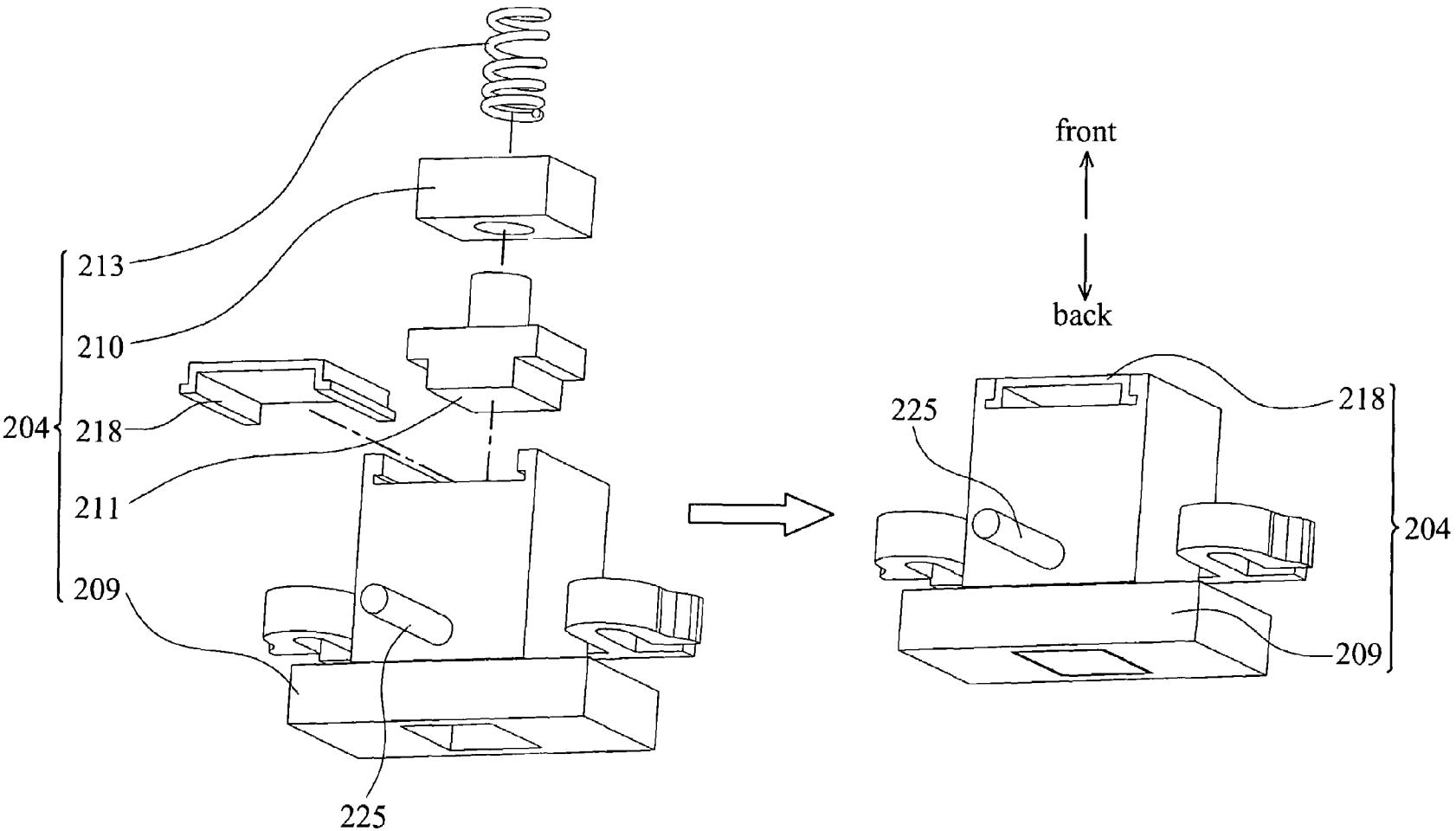
FIG. 3*b* is a partial combinative view of a push button of an embodiment of a portable communication device.
Figure 3C:
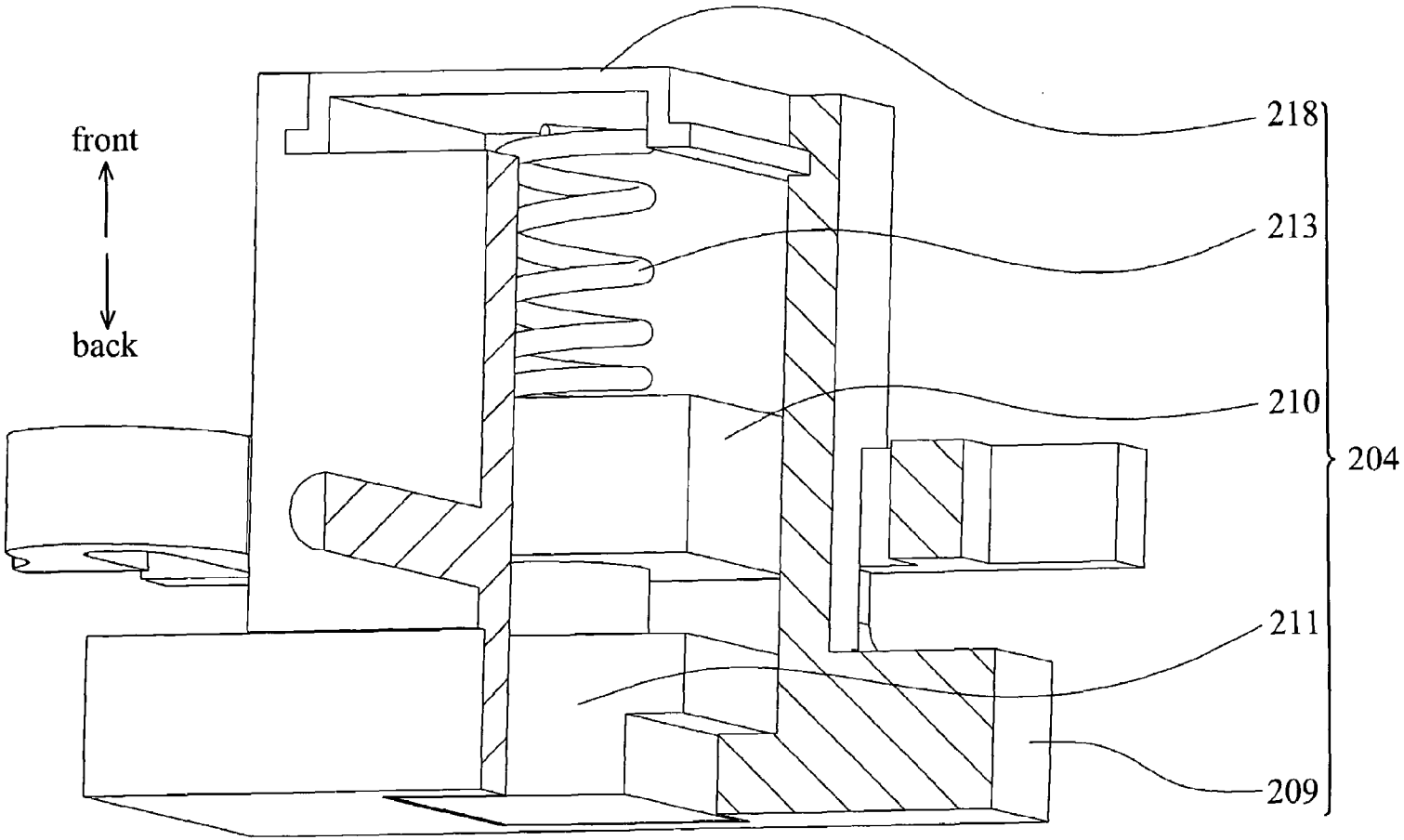
FIG. 3*c* is a cutaway view of the push button in FIG. 3*b* after combination.
Figure 3D:
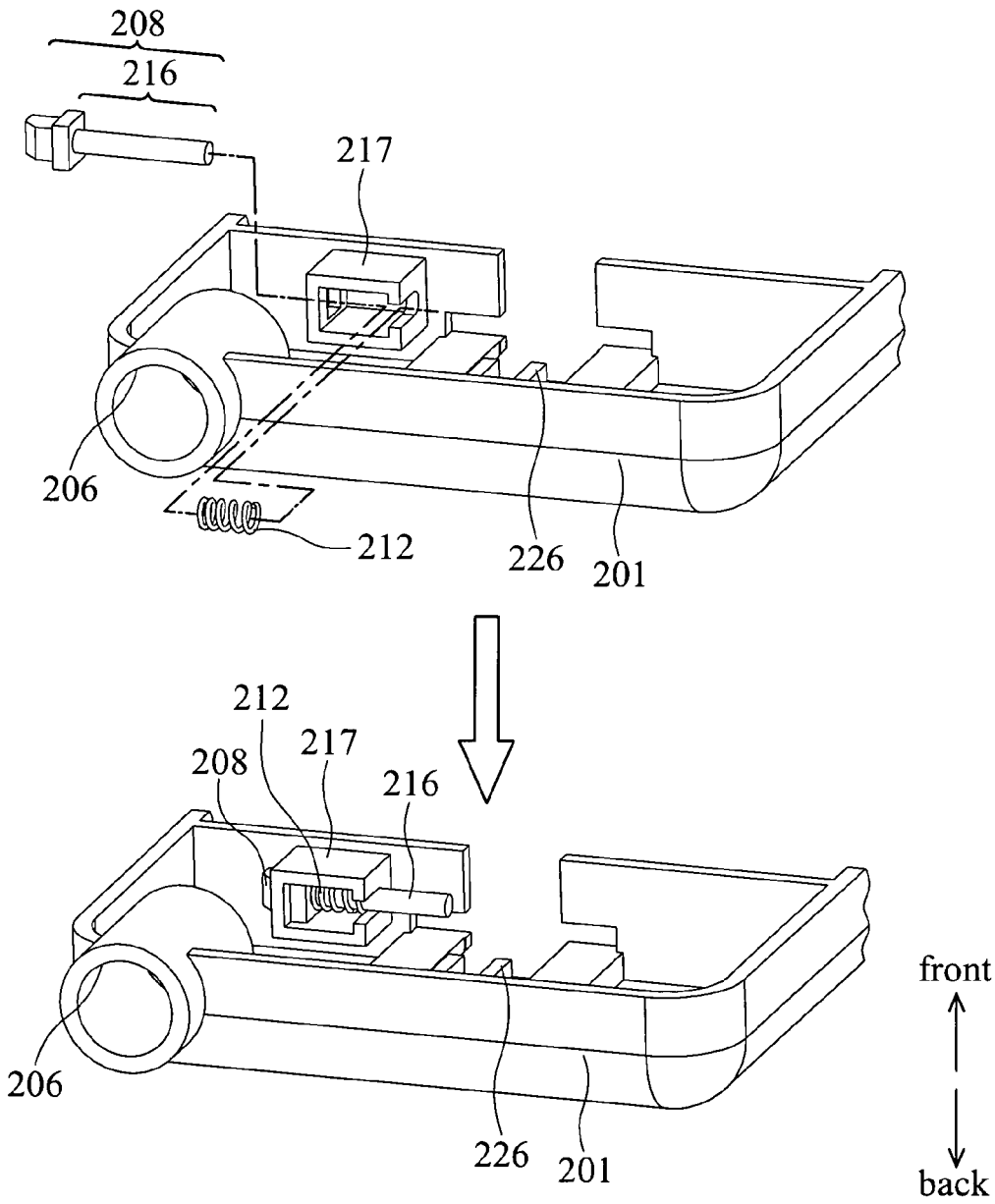
FIG. 3*d* is another partial combinative view of a push button of an embodiment of a portable communication device.
Figure 3E:
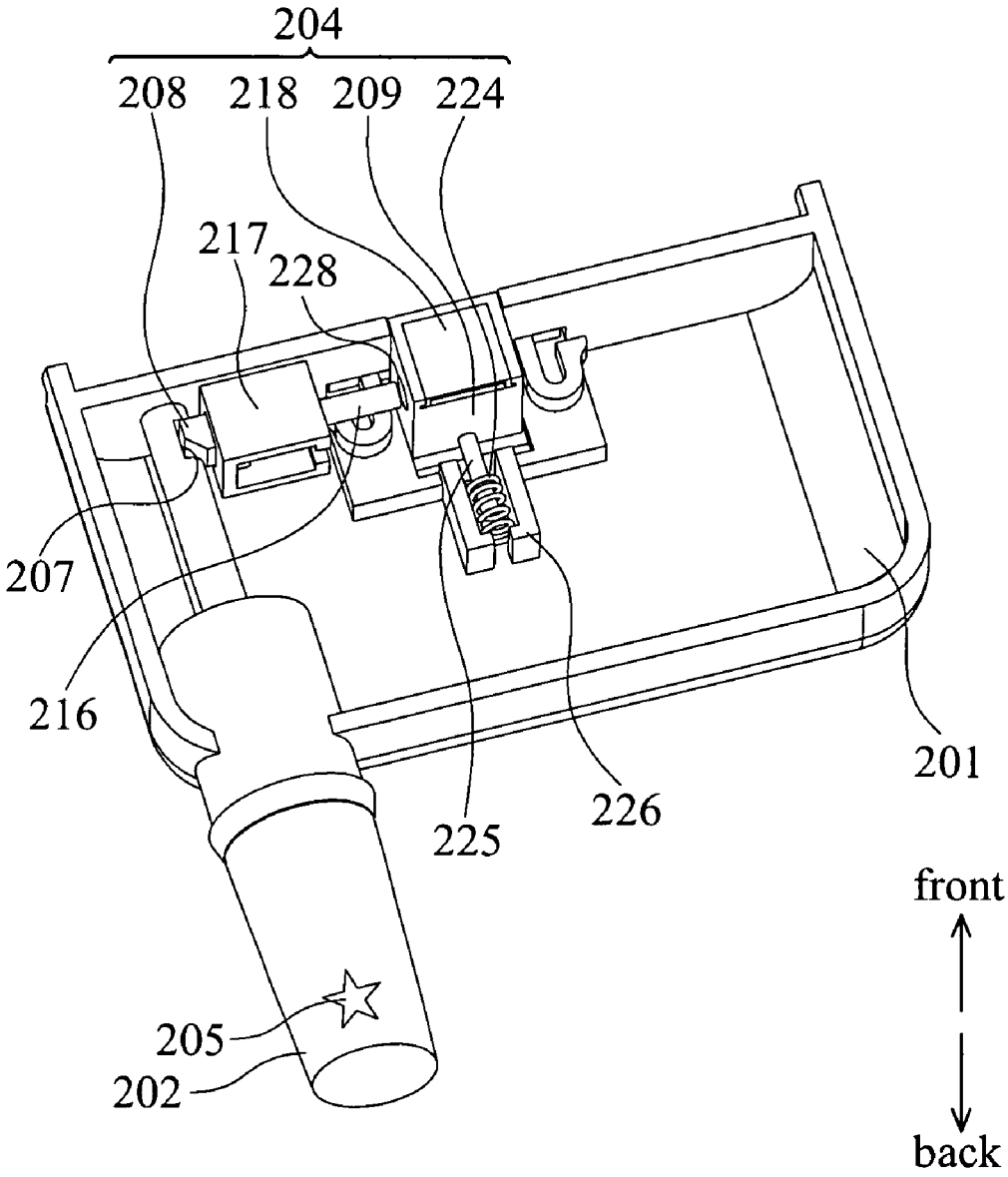
FIG. 3*e* is a schematic diagram of the portable communication device in FIG. 3*a* after combination.

FIG. 3*a* is a partial exploded view of the portable communication device 200. FIG. 3*b* is a partial combinative view of the push button 204 of the portable communication device 200. FIG. 3*c* is a cutaway view of the push button 204 in FIG. 3*b* after combination. FIG. 3*d* is another partial combinative view of the push button 204 of the portable communication device 200. FIG. 3*e* is a schematic diagram of the portable communication device 200 in FIG. 3*a* after combination.

The housing 201 comprises a first receiving portion 206. The antenna 202 is substantially cylindrical and detachably disposed in the first receiving portion 206. The first receiving portion 206 is a corresponding cylindrical space accommodating the antenna 202.

The antenna 202 comprises a first engaging portion 207. The first engaging portion 207 is a recess. The push button 204 is disposed in housing 101 and comprises a third engaging portion 208. The third engaging portion 208 is a hook. The third engaging portion 208 movably engages with the first engaging portion 207 to fix the antenna 202 to the housing 201.

The push button 204 further comprises a body 209, a magnet 210, a contact portion 211, a first spring 212, and a second spring 213. The body 209 is disposed in the housing 201 and comprises a hole 228. The magnet 210 is movably disposed in the body 209 and comprises a through hole 214. The contact portion 211 is movably disposed in the body 209 and comprises a second cylindrical portion 215. The magnet 210 is firmly fixed to the contact portion 211 by engaging the through hole 214 with the second cylindrical portion 215.

Moreover, the third engaging portion 208 is magnetically permeable, and the magnet 210 generates a magnetic attraction on the third engaging portion 208. The third engaging portion 208 comprises a first cylindrical portion 216.

The first spring 212 encircles the first cylindrical portion 216 to connect to the third engaging portion 208. The housing 201 further comprises a first stopper 217. The first spring 212 is disposed between the first stopper 217 and the third engaging portion 208, thereby applying a first resilience on the third engaging portion 208.

The second spring 213 is disposed in the body 209. The push button 204 further comprises a second stopper 218. The second spring 213 is disposed between the second stopper 218 and the second cylindrical portion 215, thereby applying a second resilience on the contact portion 211.

Figure 4A:
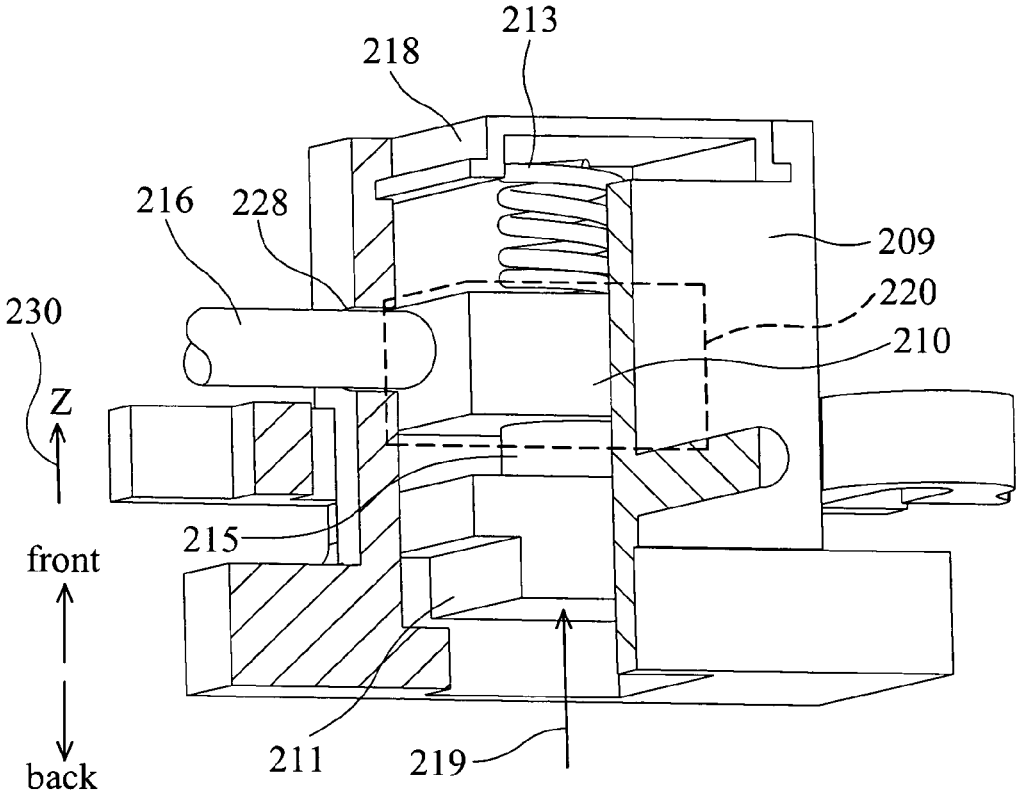
FIG. 4*a* is a cutaway view of the push button, wherein a first cylindrical portion contacts a magnet.

FIG. 4*a* is a cutaway view of the push button 204, wherein the first cylindrical portion 216 contacts the magnet 210. A first external force 219 is applied on the contact portion 211 to move the magnet 210 to a predetermined position 220. Because the predetermined position 220 is adjacent to the hole 228, the magnetic force on the first cylindrical portion 216 of the third engaging portion 208 generated by the magnet 210 is sufficient to draw the first cylindrical portion 216 of the third engaging portion 208 into the hole 228, separating the third engaging portion 208 from the first engaging portion 207, allowing detachment of the antenna 202 from the housing 201.

Figure 4B:
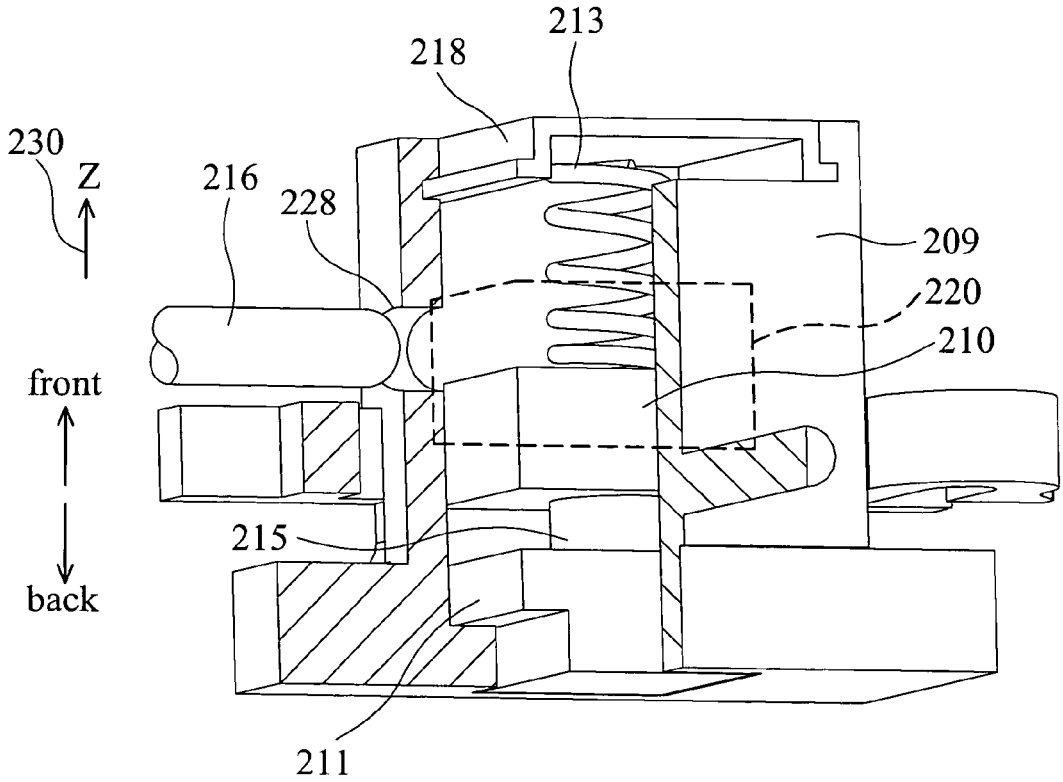
FIG. 4*b* is a cutaway view of the push button in, wherein a first cylindrical portion is separated from a magnet when a first external force ceases.

FIG. 4*b* is a cutaway view of the push button 204, wherein the first cylindrical portion 216 is separated from the magnet 210 when the first external force 219 ceases. The second spring 213 applies the second resilience to withdraw the magnet 210 from the predetermined position 220. Meanwhile, the magnetic force on the first cylindrical portion 216 of the third engaging portion 208 generated by the magnet 210 is substantially decreased. The first spring 212 applies the first resilience to move the third engaging portion 208 to the antenna 202 and engage with the first engaging portion 207, firmly fixing the antenna 202 on the housing 201.

Next, the method to detach the battery 203 from the housing 201 by the push button 204 will be described in greater detail in the following.

Figure 5A:
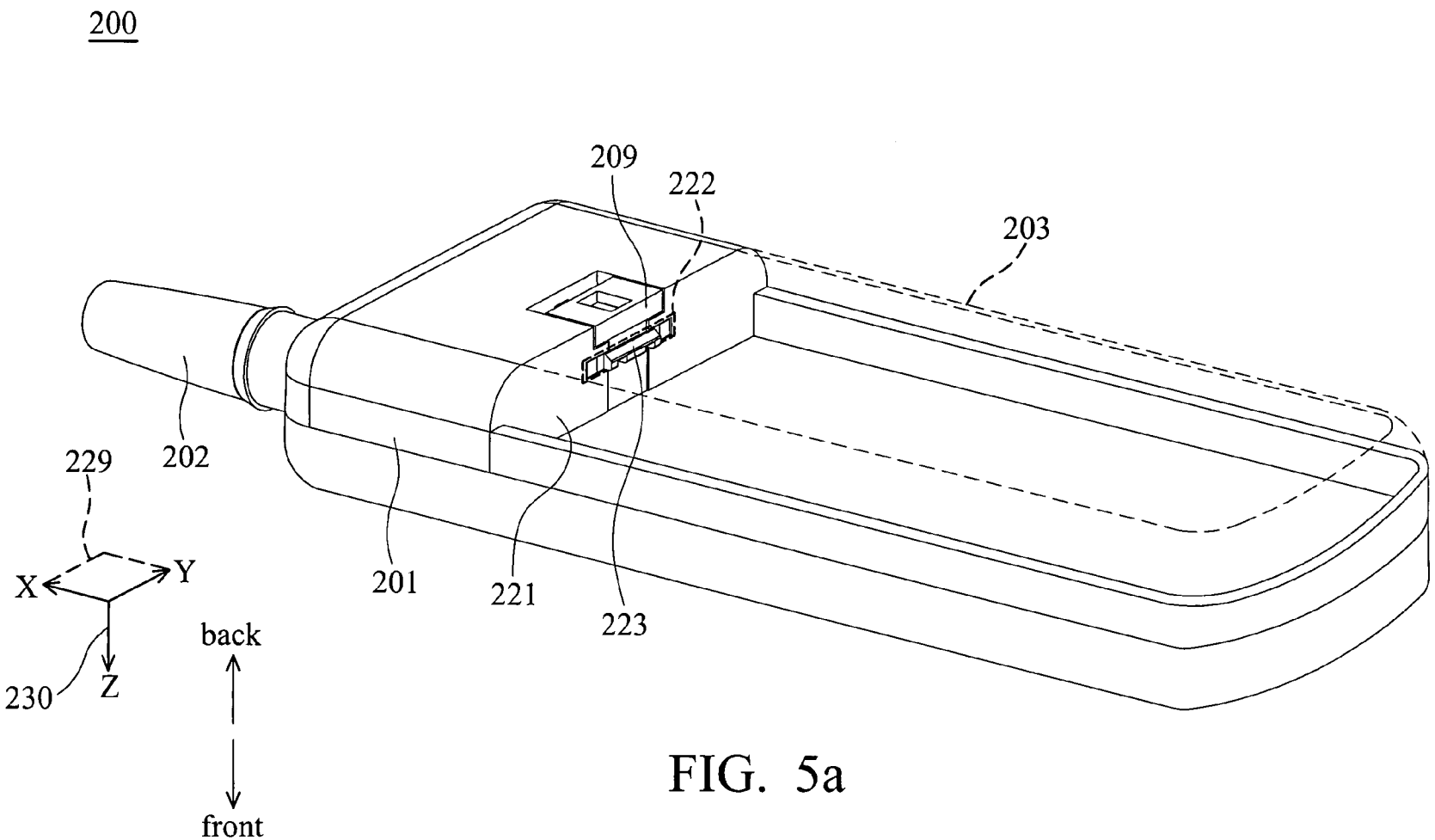
FIG. 5*a* is a schematic diagram of an embodiment of a portable communication device with a battery engaging with a fourth engaging portion.

FIG. 5*a* is a schematic diagram of the portable communication device 200 with the battery 203 (shown by dotted lines) engaging with a fourth engaging portion 223.

The housing 201 further comprises a second receiving portion 221. The battery 203 is detachably disposed in the second receiving portion 221. The second receiving portion 221 is shaped and sized to accommodate the battery 203.

The battery 203 comprises a second engaging portion 222. The second engaging portion 222 is a recess. The push button 204 further comprises a fourth engaging portion 223. The fourth engaging portion 223 is a hook. The fourth engaging portion 223 movably engages with the second engaging portion 222 to fix the battery 203 to the housing 201. The fourth engaging portion 223 and the body 209 are integral.

Referring to FIGS. 3*a* and 3*e*, the push button 204 further comprises a third spring 224. The body comprises a third cylindrical portion 225. The third spring 224 encircles the third cylindrical portion 225 to connect to the body 209. The housing 201 further comprises a third stopper 226. The third spring 224 is disposed between the third stopper 226 and the body 209, thereby applying a third resilience on the body 209.

Figure 5B:
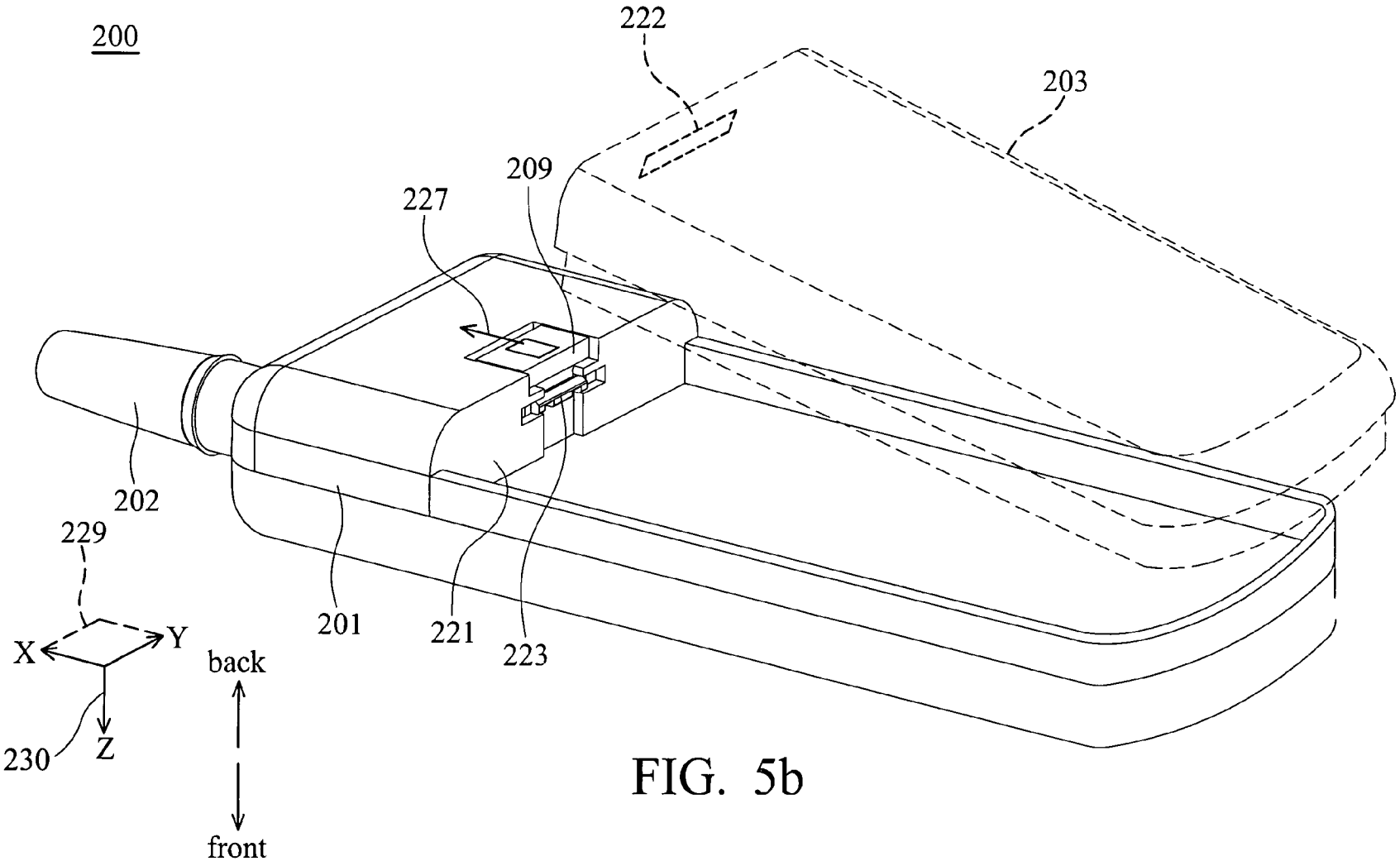
FIG. 5*b* is a schematic diagram of an embodiment of a portable communication device with a second external force applied on a body.

FIG. 5*b* is a schematic diagram of the portable communication device 200 with a second external force 227 applied on the body 209, separating the fourth engaging portion 223 from the second engaging portion 222 and detaching the battery 203 from the housing 201.

Referring to FIG. 5*a*, when the second external force 227 ceases, the third spring 224 applies the third resilience, engaging the fourth engaging portion 223 with the second engaging portion 222, firmly fixing the battery 203 on the housing 201.

It is noted that the push button 204 moves on a XY plane 229 or along a Z axis 230 (shown in FIG. 5*a*). The XY plane 229 is perpendicular to the Z axis 230. The contact portion 211 of the push button 204 moves along the Z axis 230 to separate the third engaging portion 208 from the first engaging portion 207 (shown in FIG. 4*a*), detaching the antenna 202 from the housing 201. Additionally, the body 209 of the push button 204 moves on the XY plane 229 to separate the fourth engaging portion 223 from the second engaging portion 222 (shown in FIG. 5*b*), detaching the battery 203 from the housing 201.

When the first external force 219 is applied on the contact portion 211 and the second external force 227 is applied on the body 209 simultaneously, detachment of both the antenna 202 and the battery 203 takes place.

In an embodiment of a portable communication device, an antenna can be easily replaced. Additionally, an antenna with a decorative pattern or a specific shape can be precisely positioned according to the shape and style of the portable communication device.

Moreover, an antenna and a battery can be detached from a housing simultaneously by application of two different forces on a single push button, thereby saving steps and time.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A portable communication device, comprising:

a housing comprising a first receiving portion and a second receiving portion;

an antenna detachably disposed in the first receiving portion and comprising a first engaging portion;

a battery detachably disposed in the second receiving portion and comprising a second engaging portion; and a push button disposed in the housing and comprising a third engaging portion and a fourth engaging portion;

wherein the third engaging portion movably engages with the first engaging portion to fix the antenna to the housing, and the fourth engaging portion movably engages with the second engaging portion to fix the battery to the housing.

2. The portable communication device as claimed in claim 1, wherein the antenna is substantially cylindrical, and the first receiving portion is a corresponding cylindrical space accommodating the antenna.

3. The portable communication device as claimed in claim 1, wherein the second receiving portion is shaped and sized to accommodate the battery.

4. The portable communication device as claimed in claim 1, wherein the first engaging portion is a recess, and the third engaging portion is a hook.

5. The portable communication device as claimed in claim 1, wherein the second engaging portion is a recess, and the fourth engaging portion is a hook.

6. The portable communication device as claimed in claim 1, wherein the third engaging portion is magnetically permeable, and the push button further comprises:

a body disposed in the housing;

a first spring connecting to the third engaging portion and applying a first resilience thereon; and a magnet movably disposed in the body and generating a magnetic attraction on the third engaging portion;

wherein when the magnet is in a predetermined position, the magnetic attraction separates the third engaging portion from the first engaging portion, and when the magnet is not in the predetermined position, the first spring applies the first resilience to engage the third engaging portion with the first engaging portion.

7. The portable communication device as claimed in claim 6, wherein the body comprises a hole to which the predetermined position is adjacent, and when the magnet is in the predetermined position, the magnetic attraction draws the third engaging portion into the hole.

8. The portable communication device as claimed in claim 6, wherein the housing further comprises a first stopper, and the first spring is disposed between the first stopper and the third engaging portion.

9. The portable communication device as claimed in claim 6, wherein the push button further comprises:

a contact portion movably disposed in the body and firmly fixed to the magnet; and a second spring disposed in the body, connecting to the contact portion and applying a second resilience on the contact portion;

wherein a first external force applied on the contact portion moves the magnet to the predetermined position, and when the first external force ceases, the second spring applies the second resilience to withdraw the magnet from the predetermined position.

10. The portable communication device as claimed in claim 9, wherein the push button further comprises a second stopper, and the second spring is disposed between the second stopper and the push button.

11. The portable communication device as claimed in claim 9, wherein the magnet comprises a through hole, the contact portion comprises a second cylindrical portion, and the magnet is firmly fixed to the contact portion by engagement of the through hole with the second cylindrical portion.

12. The portable communication device as claimed in claim 11, wherein the push button further comprises a second stopper, and the second spring is disposed between the second stopper and the second cylindrical portion.

13. The portable communication device as claimed in claim 1, wherein the push button further comprises:

a body disposed in the housing; and a third spring connecting to the body and applying a third resilience on the body;

wherein the fourth engaging portion is firmly fixed to the body, a second external force applied on the body separates the fourth engaging portion from the second engaging portion, and when the second external force ceases, the third spring applies the third resilience to engage the fourth engaging portion with the second engaging portion.

14. The portable communication device as claimed in claim 13, wherein the body comprises a third cylindrical portion, and the third spring encircles the third cylindrical portion to connect to the body.

15. The portable communication device as claimed in claim 13, wherein the housing further comprises a third stopper, and the third spring is disposed between the third stopper and the body.

16. The portable communication device as claimed in claim 13, wherein the fourth engaging portion and the body are integral.

17. The portable communication device as claimed in claim 1, wherein the push button moves on a XY plane or along a Z axis perpendicular to the XY plane, wherein the push button is for moving along the Z axis to separate the third engaging portion from the first engaging portion and for moving on the XY plane to separate the fourth engaging portion from the second engaging portion.

18. A portable communication device, comprising:

a housing;

an antenna detachably disposed in the housing;

a battery detachably disposed in the housing; and a push button disposed in the housing;

wherein the antenna and the battery are connected to the housing by the push button, the push button moves along a Z axis or on a XY plane to selectively separate the antenna or the battery from the housing, and the XY plane is perpendicular to the Z axis.

* * * * *